United States Patent [19]

Legrand et al.

[11] 4,071,264

[45] Jan. 31, 1978

[54] SKI AND METHOD OF MAKING SAME

[75] Inventors: Maurice François Legrand, Voiron; Gerard Cholat-Serpoud, Sillans, both of France

[73] Assignee: Skis Rossignol S.A. Club Rossignol S.A., Voiron, France

[21] Appl. No.: 697,612

[22] Filed: June 18, 1976

[30] Foreign Application Priority Data

| | | |
|---|---|---|
| June 20, 1975 | France | 75 20180 |
| Dec. 3, 1975 | France | 75 37693 |
| Dec. 3, 1975 | France | 75 37695 |
| Apr. 8, 1976 | France | 76 11270 |

[51] Int. Cl.[2] ..... A63C 5/00

[52] U.S. Cl. ..... 280/610; 280/602

[58] Field of Search ..... 280/610, 602, 607, 601

[56] References Cited

U.S. PATENT DOCUMENTS

| | | | |
|---|---|---|---|
| 2,918,293 | 12/1959 | Taui | 280/602 |

FOREIGN PATENT DOCUMENTS

| | | | |
|---|---|---|---|
| 2,130,758 | 11/1972 | France | 280/610 |
| 2,062,087 | 6/1971 | France | 280/610 |
| 2,326,892 | 12/1974 | Germany | 280/610 |

*Primary Examiner*—David M. Mitchell

*Attorney, Agent, or Firm*—Karl F. Ross

[57] ABSTRACT

A ski comprising an upper protective plate, a lower low-friction sole plate and a core of a synthetic-resin material molded between the plates and reinforced with steel filaments or wires extending the full length of the ski. Except at the spoon or toe of the ski and at the heel thereof, the steel filaments are bonded directly (without give or play) to the synthetic-resin core while at the heel and toe portions of the ski the steel filaments are bonded to the synthetic-resin core by an elastic pliable material (i.e. with give or play).

12 Claims, 6 Drawing Figures

SKI AND METHOD OF MAKING SAME

FIELD OF THE INVENTION

The present invention relates to a ski and, more particularly, to a ski having upper and lower layers or plates and a snythetic-resin reinforced core. The invention also relates to a method of fabricating such a ski.

BACKGROUND OF THE INVENTION

Considerable effort has been made in recent years to develop a technique for fabricating skis from synthetic-resin materials in place of the wood which has been required heretofore.

It has been proposed, for example, to fabricate skis from certain synthetic-resin materials, such as polyurethanes, by molding. It has also been suggested to provide a molded core of such synthetic resins with an upper protective plate which is more wear-resistant than the core and a lower sliding plate or layer (sole plate) of a material having better sliding characteristics than the core vis-à-vis the snow. The core alone is incapable of imparting to the ski the desired degree of rigidity, strength and flexibility (resilience) which is necessary for satisfactory skiing.

It will be apparent that skis made from snythetic resin have several advantages over skis having a wood core, namely lower fabrication cost, greater ease of fabrication and the like. However, none of the conventional systems for making skis with synthetic-resin cores has yet proved to be wholly satisfactory, nor have the skis themselves successfully competed with wooden-core skis from the point of view of the physical characteristics mentioned above.

OBJECTS OF THE INVENTION

It is the principal object of the present invention to provide a ski having a synthetic-resin core which possesses the physical properties of the conventional wood core and is free from the disadvantages of prior-art synethetic-resin core skis.

Another object of the invention is to provide an improved ski with the desired degree of strength, rigidity and resilience.

Still another object of the invention is to provide a low-cost method of fabricating skis of high structural qualities.

SUMMARY OF THE INVENTION

These objects and others which will become apparent hereinafter, are attained, in accordance with the present invention, in a ski which comprises, extending over the full length thereof, a protective upper plate, a sliding sole layer or plate, and a core of synthetic-resin material bridging the two plates and filling the space between them, the core being reinforced with a plurality of steel wires or filaments extending the full length of the ski.

The invention resides in the fact that, in this combination, the steel wires are bonded directly to the synthetic-resin material forming the core and which adheres, because of its molding in situ, to the steel wire and the upper and lower plates, except in the end regions of the ski in which play is permitted between the steel wires and the core, these end regions being the spoon or toe of the ski and the heel thereof. Thus, according to the invention, the molded synthetic-resin core is bonded without play to the steel wires over the entire length of the ski except at the aforementioned regions where play is permitted.

A synthetic-resin core reinforced with steel wires has certain characteristics of bodies of reinforced concrete. Such bodies, if subjected to flexure, develop shear stresses between the concrete and the reinforcing rods or bars which tend to cause separation. When steel filaments or wires are molded in situ in a body of synthetic-resin material, forming the core of the ski, similar problems have been found to develop when there is direct bonding relationship between the core material and the filament at the region of maximum flexture. These flexture forces are concentrated primarily at the spoon or toe of the ski and the heel thereof and were found, in our experiments, to give rise to shear forces which result rapidly in a separation of the several layers of the ski and render the same unusable.

The ski of the present invention does not have this defect because in these zones which are primarily subject to flexture, the bond between the core and the steel wires is effected plastically, i.e. by interposition of an elastic or pliable body between the wires and the core material, the pliable body having a greater "give" than the core material.

According to the invention, therefore, in each of the aforementioned terminal zones of the ski, i.e. the spoon or toe and the heel thereof, between the material constituting the core and the steel wires serving as an armature, we provide a layer of a resin having elastic properties and pliability in excess of those of the material constituting the core but bonded to the latter and preferably to the steel wires. The steel wires can, therefore, be coated with the more pliable and elastic synthetic resin or can be formed with a sheath thereof at each end of each reinforcing wire.

For effective distribution of the forces, i.e. for maximum force equilibrium within the ski, it has been found to be advantageous to dispose the reinforcing wires in part (i.e. in a layer) along an upper portion of the core and in part along the lower portion of the core, while providing the lower portion with a pair of steel edge strips as well. For a long ski, preferably of the type suitable for adults, five or more such reinforcing wires can be provided in a staggered pattern with the lower wires disposed between the upper wires. In a preferred embodiment, moreover, four upper wires are provided in one layer and two lower wires are provided in the other layer, the two lower wires being disposed directly below the midpoint between each of the two pairs of upper wires. The edge reinforcements can preferably overlap the lower or sole plate. The wires alternating between the upper and lower layers can, therefore, be staggered.

This arrangement has been found to be especially advantageous in providing the ski with the desired rigidity, strength and toughness. It also permits the screws which may be used for fastening the ski bindings to be inserted between the wires.

The wires may converge toward the ends of the ski. This permits the end regions of the ski to be of reduced thickness.

In the region of the terminal zones of the ski, which are subjected to significant flexture, particularly at the spoon or to thereof, there is a greater tendency for the ski to suffer transverse rupture and hence we can provide in the lower part of the core a supplemental reinforcement of planar configuration which can extend along the greater part of the length of the spoon or toe and can be disposed principally between the lower reinforcing wires. This has been found to resist the lateral forces upon the ski and reduce the internal stresses resulting from the disposition of a greater number of reinforcing wires in the upper region than in the lower region thereof. Advantageously this planar supplemental reinfocement is a porous material, e.g. a fabric, which is penetrated by the synthetic-resin material constituting the core. If composed of a textile or fabric, it should be inextensible, e.g. a glass fabric, this Fiberglass inlay serving as a transverse reinforcement.

In practice it has been found that at least the central wires of the upper layer of the reinforcement can be omitted in the binding-mounting zones of the ski without materially decreasing the essential physical properties mentioned above. It is possible, therefore, to interrupt the central wires and to connect them to a metallic mounting plate which is embedded in the bore and is disposed between the outer wires of the upper layer. This plate can be perforated, to receive screws for attaching the skiboot bindings, or unperforated as desired. The steel cords can be attached to this plate, for example, by soldering or welding.

For short or children's skis, of a length between 100 and 130 cm, it has been found to be advantageous to dispose the reinforcing wires in a single plane and to provide only two such wires in spaced-apart relationship. It has been found that the six-wire arrangement described above, in which the wires are grouped in threes at the vertices of a triangle on either side of the median plane through the ski, affords too great a stiffness for use in such short skis.

Because the toe and heel sections of these skis make up a proportionately greater percentage of the overall length in such short skis, it has been found that the elastic connection between the reinforcement and the core material at both ends may not suffice for an effective anchorage of the reinforcement or permit the steel reinforcing wires to fully play a reinforcing role.

According to the invention the contact surface between the core and one extremity of each wire can be provided with an additional mechanical anchorage in the synthetic-resin material designed to supplement the elastic connection. The additional anchorage can be provided in various ways and is preferably effected by surrounding the extremity of each wire with one or more small metallic rings which can be attached to the wire by welding or soldering and constituting a shoulder which is embedded in the core of the ski, preferably through the intermediary of the elastic material described above. This type of anchorage increases the mechanical connection of the wire to the core material while retaining the advantages of the elastic connection described previously. Of course, the steel wire need not be rectilinear at its terminal portions but can be provided with a sinusoidal configuration or with bends to provide the additional anchorage.

BRIEF DESCRIPTION OF THE DRAWING

The above and other objects, features and advantages of the present invention will become more readily apparent from the following description, reference being made to the accompanying drawing which shows two embodiments of the invention and in which.

SPECIFIC DESCRIPTION

Figure 1:
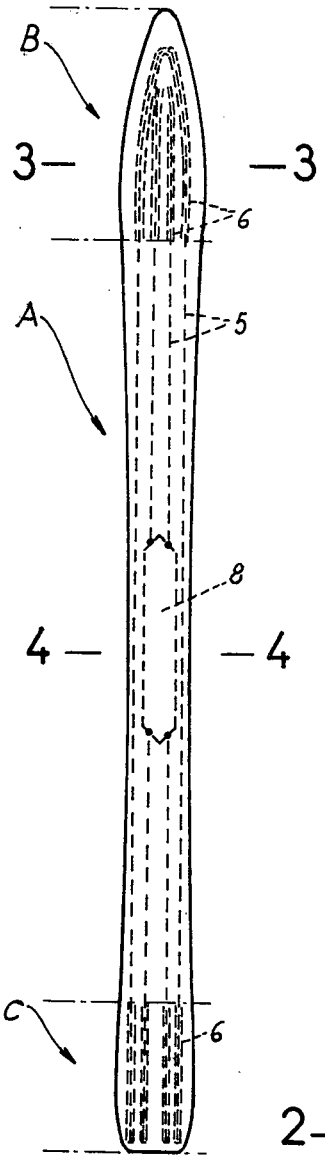
FIG. 1 is a top plan view of a ski normal length embodying the invention and diagrammatically illustrating same.

The exterior of the ski of the present invention has a conventional configuration and comprises three essential parts, namely, the central zone A extending over the major portion of the length of the ski, the spoon or toe B at the forward end thereof, and the rear or heel C at the opposite end of the ski blade.

In these three zones the ski comprises a core 1 of a molded or cast synthetic-resin material, preferably polyurethane, an upper plate 2 serving as a wear-resisting protective layer, and a sliding sole plate 3 constituted, for example, of polyethylene. The protective plate 2 can also be composed of polyethylene.

Over the entire length of the ski there are provided two edge pieces of steel 4 which form the lower edge portions of the ski and have flanges overlapping the lower plate 3 which can be formed with a central groove as is conventional for the snow-engaging surface of a ski.

All along its length, the core 1 is reinforced with steel wires 5 which are cast in and bonded to the core material during the molding thereof.

According to an essential characteristic of the invention, the core material is bonded directly to the steel wires only in the central zone A of the ski, without play. This bond is analogous to the bond formed between concrete and steel reinforcing rods cast therein. However, in the two zones B and C, constituting the toe and heel regions of the ski, respectively, there is no direct contact between the steel wires 5 and the core 1.

In each of these latter zones a pliable elastic element 6 is interposed between each steel wire 5 and the core material, being bonded to the latter. The pliable elements 6 can be formed in various ways and preferably consist of a pliable synthetic resin or elastomer which is coated onto the steel wire 5 or is previously formed as a sheath which is force-fitted over the wires 5 for the full lengths of the zones B and C, respectively.

In either case, the core 1 and its reinforcement 5 is elastic in the zones B and C. Because of this elastic connection, the toe and heel of the ski are capable of resisting the violent forces of flexure to which these parts of the ski are subject in conventional usage. The ski of the present invention is thus capable of withstanding these flexure forces without separation of the various elements from which the ski is formed.

Figure 2:
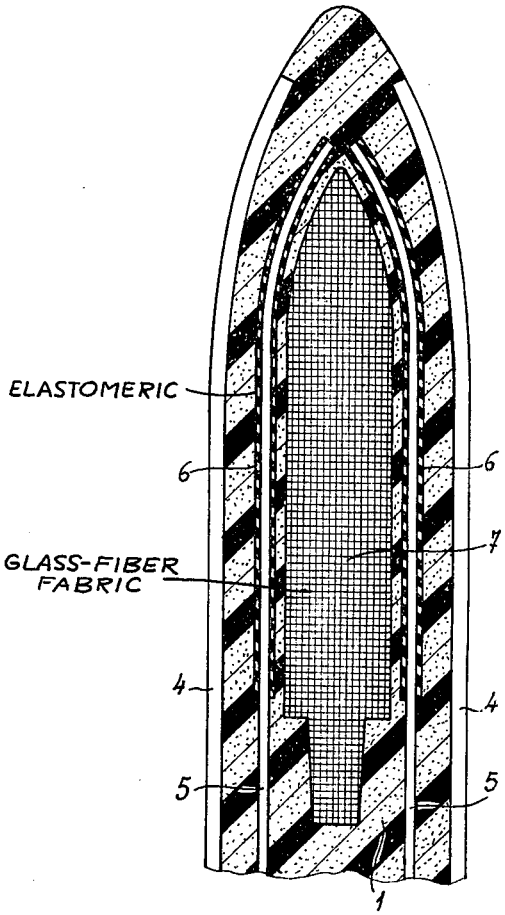
FIG. 2 is a horizontal section along the line 2 — 2 of FIG. 3, drawn to a larger scale than that of FIG. 1 but a smaller scale than that of FIG. 3, of the spoon or toe portion of the ski.
Figure 3:
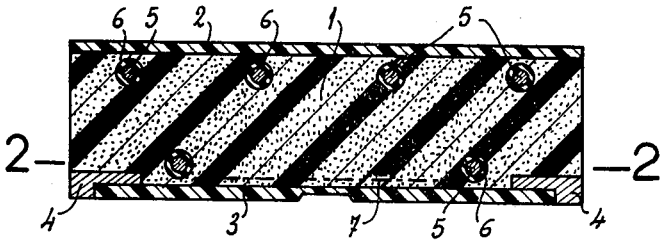
FIG. 3 is a transverse section along the line 3 — 3 of FIG. 1.

As is shown in FIG. 3, the core 1 is additionally reinforced at the forward end of the ski, i.e. at the spoon or toe thereof, with a reinforcement 7 which is disposed between the two lower reinforcing wires 5 and which has the configuration shown in FIG. 2. The reinforcement 7 can be a strip of glass-fiber fabric which is relatively permeable so as to permit the penetration therethrough of the siquid synthetic resin which is cast to form the core 1. The glass-fiber fabric 7 extends preferably over the entire length of the toe zone B in the plane of the bottoms of the lower two wires 5.

The fabric 7 is an inextensible reinforcement which provides not only longitudinal support but also transverse reinforcement in the interior of the toe portion of the ski. Rupture resulting from antagonistic stresses on the reinforcement wires because of the stresses to which the toe portion of the ski is subject, is thus precluded.

Figure 4:
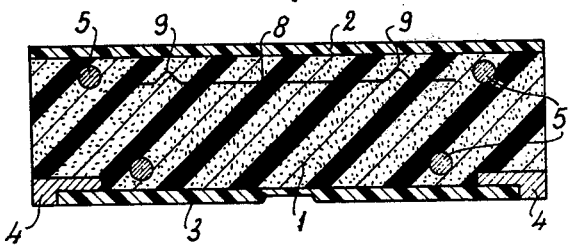
FIG. 4 is a section taken along the line 4 — 4 of FIG. 1.

The two outermost steel cords of the upper portion of the ski extend over the full length thereof while the two inner steel cords of the upper reinforcing layer are interrupted in the central region of the ski. In the central region there is provided a metallic plate which is welded or soldered at its ends to the interrupted ends of the inner pair of steel wires 5 and serves to facilitate mounting of the ski binding. The metallic plate need not be of great thickness but its rigidity or stiffness can be increased by imparting to it a corrugated or ridged profile as seen in cross-section in FIG. 4. As can be seen from this Figure, the plate can be provided with a pair of ridges or corrugations 9 which stiffen the plate 8 against deformation during casting or the expansion of the synthetic-resin material within the mold.

In the case of an adult-length ski, it is preferred to provide five or six steel filaments (see FIG. 3) in a staggered arrangement. Best results are provided when two groups of filaments are provided along each side of the ski, the two upper filaments of each group and the lower filament disposed between them lying at the vertices of an isosceles or equilateral triangle.

Figure 5:
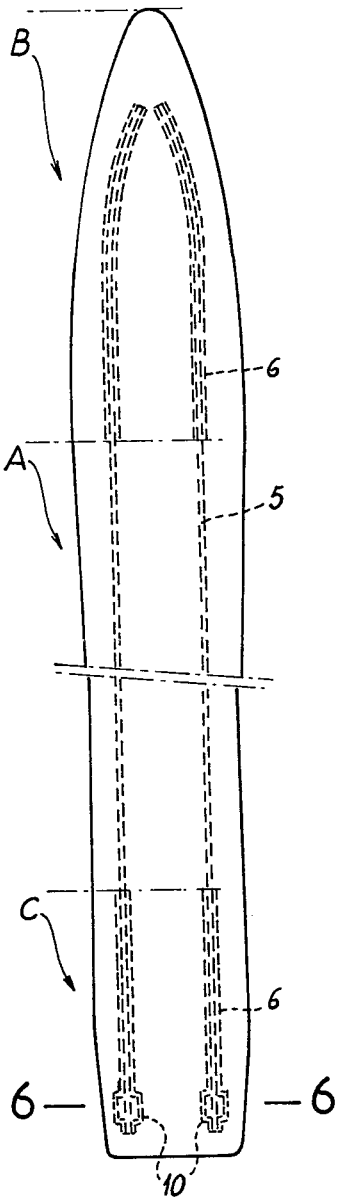
FIG. 5 is a view similar to FIG. 1 of a short ski according to the invention.
Figure 6:
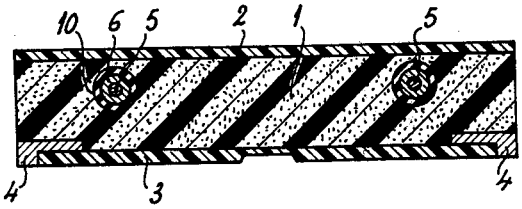
FIG. 6 is a transverse section along the line 6 — 6 of FIG. 5.

The number of reinforcements is reduced in the case of a short ski intended for children, as shown in FIGS. 5 and 6.

In the central zone A of such a short ski, there is a direct bond between the core material 1 and the steel wires. A pliable or elastic sheath is provided between the wires 5 and the core material in the toe zone B of the ski. However, in the heel or rear zone C of the ski, the bond between the core material and the steel wires is augmented by surrounding the steel wires with metallic rings 10 which are welded or soldered to the wires and form shoulders which increase the anchorage of each wire in the core. The rings 10 can be surrounded with the elastic material 6 to ensure both a mechanical and an elastic bond to the core material.

The ski according to the invention thus has just the stiffness and strength desired, without being susceptible to rupture in the rear portions of the ski between the steel wire and the core, even though a greatly reduced number of wires is provided in this ski. The ring-type addition to the anchoring force, illustrated in connection with the short of children's ski, may also be used for the adult-size ski of the embodiment of FIGS. 1 - 4.

The ski of either embodiment is relatively simple, has the requisite strength, rigidity and resilience, and can be fabricated simply and at low cost.

According to the invention, the ski is produced directly by molding without preformation of the core. To this end, a mold is provided of the shape of the ski and the upper plate 2 is disposed therein, the lower plate 3 is held in spaced relationship from the upper plate, and the steel wires 5 are spanned across the length of the mold (e.g. by being suspended from the plates) after having been provided with the pliable-resin coatings or sheaths 6 in regions corresponding to the toe and heel of the ski. The reinforcement 7 and the plate 8 are similarly disposed in the mold and the edges of the mold are provided with the lower edge strips 4. Foamable polyurethane resin is then introduced into the space between the plates and permitted to fill the mold and expand to form the core therof.

We claim:

1. A ski comprising:

a protective upper plate;

a lower sliding plate spaced from said upper plate;

at least one layer of transversely spaced longitudinally extending steel reinforcing wires lying between said plates;

an elongated core of synthetic-resin material having front and rear regions, said core being disposed between said plates and surrounding said wires, said wires being in contact with and fixed to the synthetic resin of the core without play over the length of the ski except at front and rear regions thereof; and elastic means interposed between said core and surrounding each of said wires at said regions for preventing contact between said synthetic resin of the core and said wires at said regions, while permitting relative displacement between said wires and the synthetic resin at said regions.

2. A ski as defined in claim 1 wherein said elastic means is a layer of an elastic resin covering said wires in said regions.

3. A ski as defined in claim 1 wherein said elastic means is a respective sheath of a pliable elastic material surrounding said wires in said regions and interposed between the wires and the core.

4. The ski defined in claim 3, further comprising a ring enclosed in at least one of said sheaths at an end of the corresponding wire for increasing the anchorage thereof in said core.

5. The ski defined in claim 4 wherein said rings increase the contact surface between the core and said elastic means at the end of each wire.

6. The ski defined in claim 4 wherein said rings are formed on each of said ends of each wire and define a shoulder embedded in said core.

7. The ski defined in claim 1 wherein each of said wires extends rectilinearly along at least the central portion of the ski and is nonrectilinear at least at one end of the respective wire.

8. The ski defined in claim 7 wherein the nonrectilinear end of said wire is curved.

9. The ski defined in claim 1, further comprising a planar reinforcement embedded in said core and extending over at least the greater portion of the length of said front region and flanked by a pair of such wires.

10. The ski defined in claim 9 wherein said reinforcement is constituted by an inextensible textile fabric.

11. The ski defined in claim 1 wherein some of said wires are interrupted at a central portion of the ski, said ski further comprising a metal plate embedded in said core and anchored to the interrupted wires, said plate being adapted to secure the bindings to the ski.

12. The ski defined in claim 11 wherein said wires are disposed in two layers, an upper layer proximal to said protective plate and a lower layer proximal to said sliding plate, said interrupted wires being of said upper layer.

* * * * *